United States Patent [19]

Calverley et al.

[11] Patent Number: 4,690,604

[45] Date of Patent: Sep. 1, 1987

[54] CONVEYING APPARATUS FOR ROD-LIKE ARTICLES

[75] Inventors: Simon G. Calverley, Heaton Chapel; David C. M. Carter, Milton Keynes; Peter A. Clarke, London; John G. Dowding, Milton Keynes; David M. Hawkins, Milton Keynes; Robert J. C. S. Mitchell, Milton Keynes, all of United Kingdom

[73] Assignee: Molins PLC, London, United Kingdom

[21] Appl. No.: 628,304

[22] Filed: Jul. 6, 1984

[30] Foreign Application Priority Data

Jul. 6, 1983 [GB] United Kingdom ..... 8318304

[51] Int. Cl.[4] ..... A24C 5/35

[52] U.S. Cl. ..... 414/403; 414/421

[58] Field of Search ..... 414/403, 404, 420–422, 414/413, 419; 198/347, 412; 131/107, 282, 283

[56] References Cited

U.S. PATENT DOCUMENTS

| | | | |
|---|---|---|---|
| 3,550,799 | 12/1970 | Marradi | 414/421 X |
| 3,774,791 | 11/1973 | Bornfleth | 414/403 X |
| 4,229,137 | 10/1980 | Molins | 198/347 X |
| 4,344,727 | 8/1982 | Chaloupka | 198/412 X |
| 4,585,386 | 4/1986 | Gomann et al. | 414/403 |

FOREIGN PATENT DOCUMENTS

| | | | |
|---|---|---|---|
| 1299174 | 12/1972 | United Kingdom . | |
| 1404142 | 8/1975 | United Kingdom . | |
| 1430061 | 3/1976 | United Kingdom . | |
| 1453191 | 10/1976 | United Kingdom . | |
| 1517772 | 7/1978 | United Kingdom . | |
| 1532421 | 11/1978 | United Kingdom . | |
| 2007964 | 5/1979 | United Kingdom . | |
| 1557458 | 12/1979 | United Kingdom . | |
| 2024758 | 1/1980 | United Kingdom | 414/403 |
| 2056397 | 3/1981 | United Kingdom . | |
| 2066761 | 3/1981 | United Kingdom . | |
| 2124174 | 2/1984 | United Kingdom . | |
| 197801 | 8/1976 | U.S.S.R. | 198/412 |

*Primary Examiner*—Joseph E. Valenza
*Assistant Examiner*—David A. Bucci
*Attorney, Agent, or Firm*—Antonelli, Terry & Wands

[57] ABSTRACT

Apparatus for conveying rod-like articles between a delivery device (M), e.g. a cigarette maker, and a receiving device (P), e.g. a cigarette packer, includes a conveyor (C) for articles in stack formation, a container loading device (TF), a container unloading device (TU), and a container handling system (TS) for moving containers between the devices. The container loading and unloading devices (TF, TU) may be in non-parallel orientations and the container handling system (TS) may include a common container reservoir (ER, FR) and a container turning device (FTT, ETT). The container loading and unloading devices (TF, TU) may be linked to the main conveyor (C) by subsidiary conveyors (CTF, CTU) which include a twisting path portion (SC).

33 Claims, 28 Drawing Figures

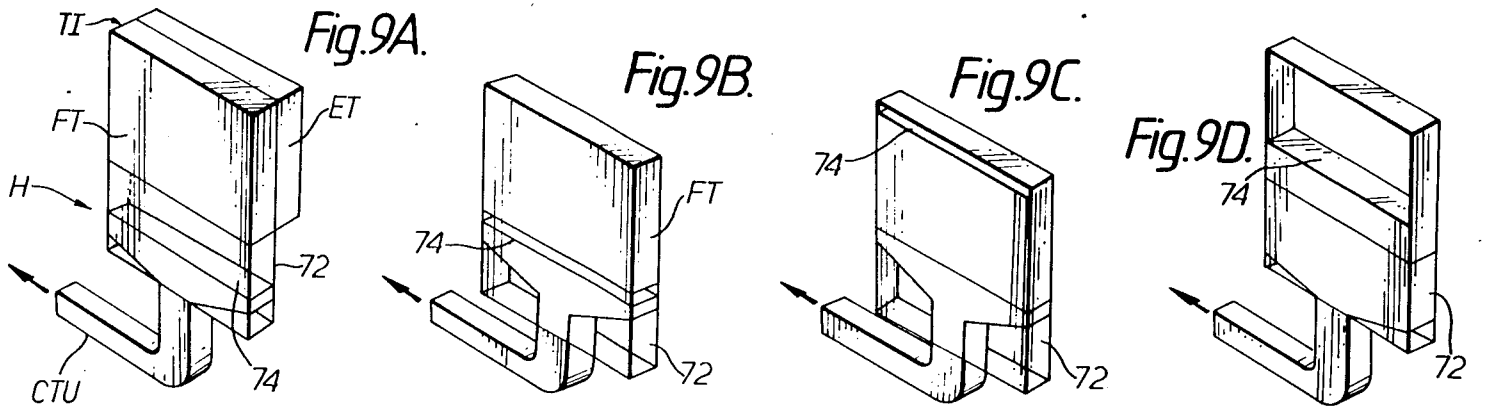
Fig.9A.
ET
72
74
TI
FT
H
CTU
Fig.9B.
FT
72
74
Fig.9C.
72
74
Fig.9D.
72
74
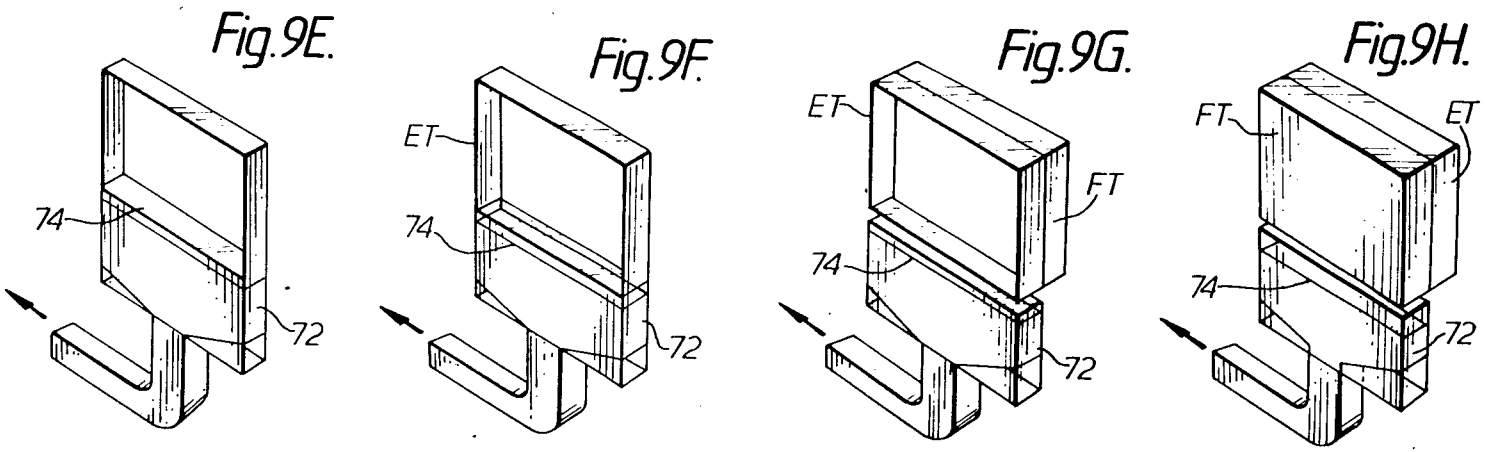
Fig.9E.
72
74
Fig.9F.
72
ET
74
Fig.9G.
FT
72
ET
74
Fig.9H.
ET
72
FT
74

CONVEYING APPARATUS FOR ROD-LIKE ARTICLES

This invention relates to apparatus for conveying rod-like articles, particularly articles of the tobacco industry such as cigarettes or filter rods.

In the cigarette industry it is known to link a machine for producing rod-like articles, e.g. a cigarette making machine or filter rod making machine, to a tray filler or similar machine for placing the articles in containers. Subsequently, the full containers are unloaded by a tray unloader or the like and delivered to a receiving machine, e.g. a cigarette packing machine or filter rod pneumatic distribution unit. It is also known to form rod-like articles into a substantially continuous stream for delivery from a producing machine to a receiving machine. It is further known to provide means for loading containers from such a stream and means for unloading the contents of containers for delivery to the stream. Examples of systems such as this are disclosed in British Patent Specifications Nos. 1404142 and 1557458.

According to one aspect of the present invention apparatus for conveying rod-like articles comprises an article delivery device, an article receiving device, conveyor means for conveying articles away from the delivery device and for conveying articles towards the receiving device, said conveyor means being arranged to convey articles in multi-layer stack formation, a container loading position, a container unloading position, said loading and unloading positions being arranged to receive containers in non-parallel orientations, a first subsidiary conveyor linking the container loading position with said conveyor means, a second subsidiary conveyor linking the container unloading position with said conveyor means, and a container handling system including means for conveying a container between said loading and unloading positions, said container conveying means including means for turning a container about an axis substantially at right angles to articles in said container. The container conveying means may include first means for turning full containers and second means for turning empty containers. The first and second turning means may be arranged at different levels. The turning means may include a container support pivotable about an axis (which may be substantially vertical). The turning means may also be capable of elevating or lowering a container (e.g. the support may be movable along a vertical pivot axis). The container is preferably a conventional cigarette or cigarette filter rod tray.

In a preferred arrangement the container unloading position is substantially parallel to the main conveyor (or to a portion of it to which the second subsidiary conveyor connects) and the container loading position is substantially at right angles to the container unloading position. The conveyor turning means is arranged to turn the containers preferably through 90°. The container handling device may include an empty container reservoir and a full container reservoir, each arranged to feed containers respectively directly to and from the container loading position in a direction at 90° to that position. Thus the container loading position may be arranged at one end of a container reservoir and the container unloading position may be arranged at the other end with container turning means arranged close to said unloading position. With this arrangement, assuming that the main conveyor is straight, the first subsidiary conveyor preferably includes a 90° twist (preferably a spiral downdrop conveyor).

The apparatus may include a first junction between the first subsidiary conveyor and the conveyor means, and include means for turning articles about an axis substantially transverse to their lengths during conveyance in multi-layer stack formation downstream of said first junction. At least one of the subsidiary conveyors may include the article turning means, which include means for twisting articles about an axis parallel to their direction of movement. The conveyor means itself may include the article turning means. The container turning means may be arranged to turn articles through a first angle and the article turning means may be arranged to turn articles through a second angle, the sum of said first and second angles being 180°. Preferably said first and second angles are 90°.

It will be appreciated that with container unloading devices of the type commonly in use, which overturn a container for direct conversion of the container contents into a continuous stream, the orientation of the articles is changed 180° (during overturning). Since there is no change in orientation on direct loading into containers with most forms of container loading device, a correction of orientation of 180° is required to return to a stream by means of a container unloading device articles removed from the same stream by a container loading device.

According to a further aspect of the invention apparatus for conveying rod-like articles comprises an article delivery device, an article receiving device, conveyor means for conveying articles away from the delivery device and for conveying articles towards the receiving device, said conveyor means being arranged to convey articles in multi-layer stack formation, a container loading position, a container unloading position, a first subsidiary conveyor linking the container loading position with said conveyor means, a second subsidiary conveyor linking the container unloading position with said conveyor means, and a container handling system including means for conveying a container between said loading and unloading positions, said container conveying means including a common container reservoir from which reservoir empty or full containers are delivered respectively to said loading position or said unloading position, a secondary reservoir from which containers may be added to or removed from said container conveying means, and means for transferring containers between said common reservoir and the secondary reservoir.

Preferably said common reservoir includes unidirectional container conveyors and said secondary reservoir includes at least one reversible container conveyor. In a preferred arrangement the secondary reservoir is arranged at 90° to the common reservoir and said transferring means includes container turning means. Said common reservoir may include full and empty container conveyors for delivering and receiving containers directly to and from the container loading position. The container turning means may be separate for full and empty containers and cooperate with vertically spaced full and empty container reservoirs. In a further preferred arrangement the common container reservoir is associated with one of said container loading position and said container unloading position and the secondary container reservoir is associated with the other of said positions, said transferring means being arranged to supply containers to an intermediate position of said secondary reservoir, from which intermediate position a container may be delivered in opposite directions either to said other position or to a further position at which containers may be added to or removed from the container conveying means (e.g. by an operator). Preferably said one position is the container loading position and said other device is the container unloading position. An elevator or the like may be provided at said further position to enable containers to be added to or removed from the container conveying means.

According to a further aspect of the invention, apparatus for conveying rod-like articles comprises an article delivery device, an article receiving device, conveyor means for conveying articles away from the delivery device and for conveying articles towards the receiving device, said conveyor means being arranged to convey articles in multi-layer stack formation, a container loading position, a container unloading position, a first subsidiary conveyor linking the container loading position with said conveyor means, a second subsidiary conveyor linking the container unloading position with said conveyor means, and a container handling system including means for conveying a container between said loading and unloading positions, wherein at least one of said first and second subsidiary conveyors includes a portion along which articles are turned about an axis at 90° to their lengths, and at least one of said loading and unloading positions is arranged at 90° to an adjacent portion of said conveyor means.

According to a further aspect of the invention, apparatus for conveying rod-like articles comprises an article delivery device, an article receiving device, conveyor means for conveying articles away from the delivery device and for conveying articles towards the receiving device, said conveyor means being arranged to convey articles in multi-layer stack formation, a container loading position, a container unloading position, a first subsidiary conveyor linking the container loading position with said conveyor means, a second subsidiary conveyor linking the container unloading position with said conveyor means, said loading and unloading positions being arranged so that said first and second subsidiary conveyors respectively convey articles in different orientations adjacent said positions, a container handling system including means for conveying a container between said loading and unloading positions, said container conveying means including means for turning a container about an axis substantially at right angles to articles in said container, and means for turning articles about a substantially transverse axis during conveyance in multi-layer stack formation, whereby articles on said second subsidiary conveyor may be recombined with articles on said conveyor means in the same orientation.

The invention will be further described, by way of example only, with reference to the accompanying diagrammatic drawings, in which.

Figure 8:
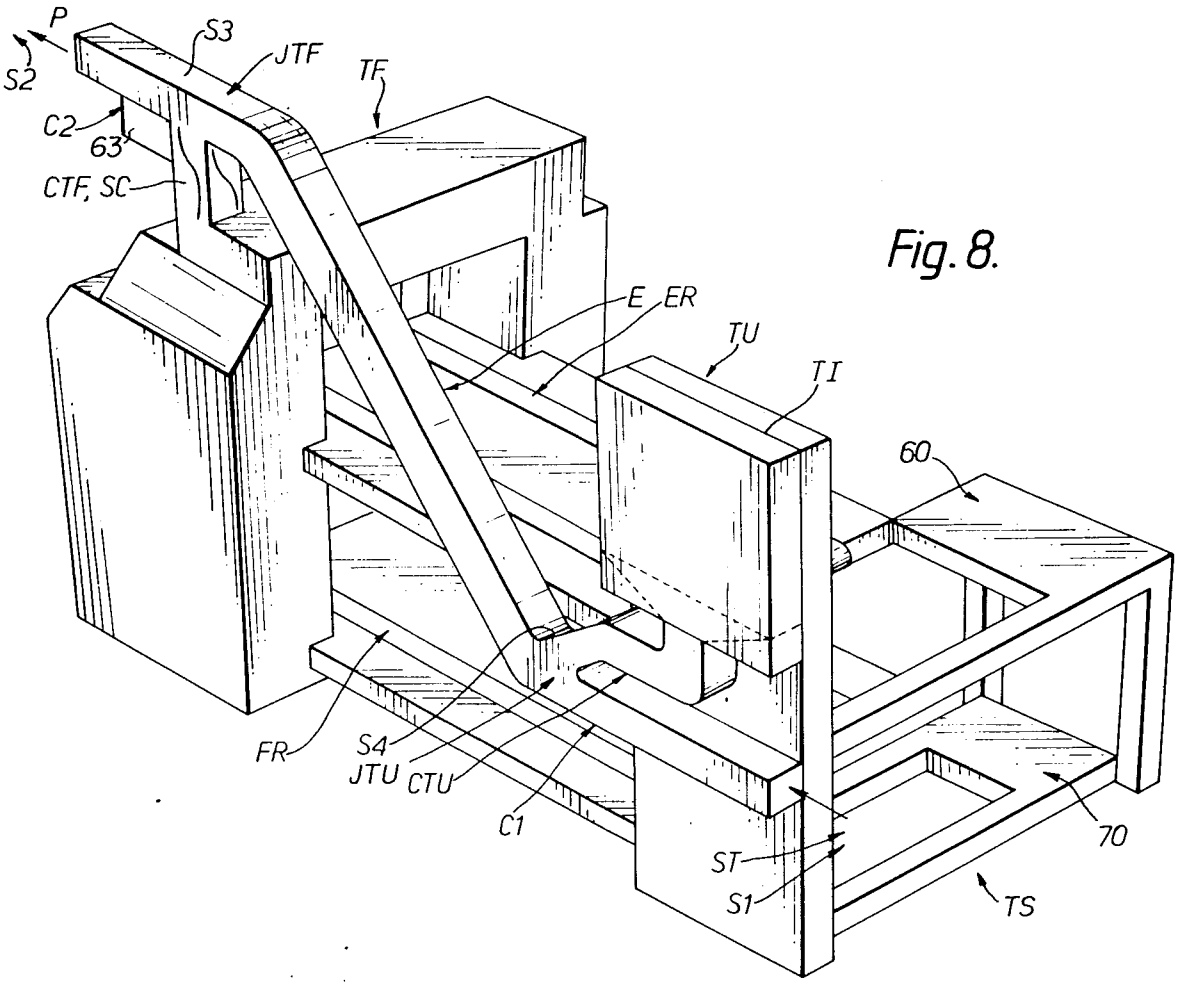
FIG. 8 is a perspective view a further tray reservoir system.
Figure 10:
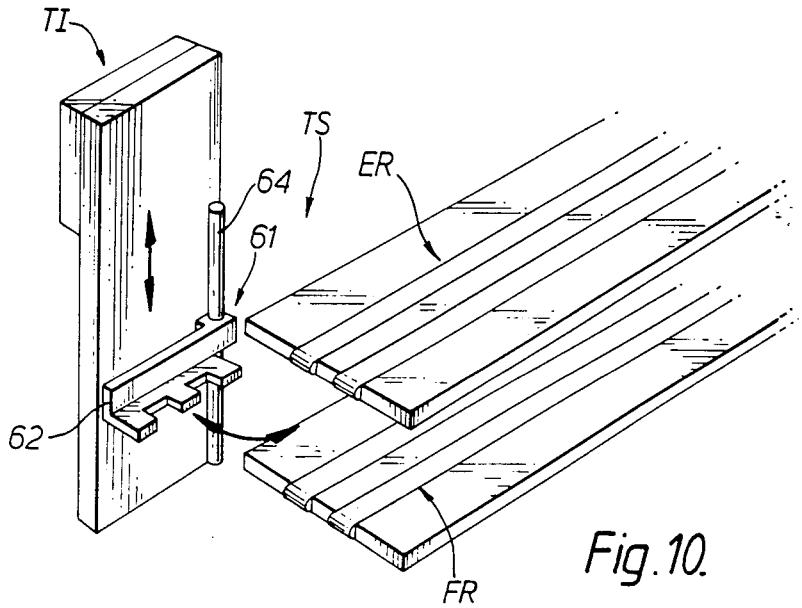
Figure 11:
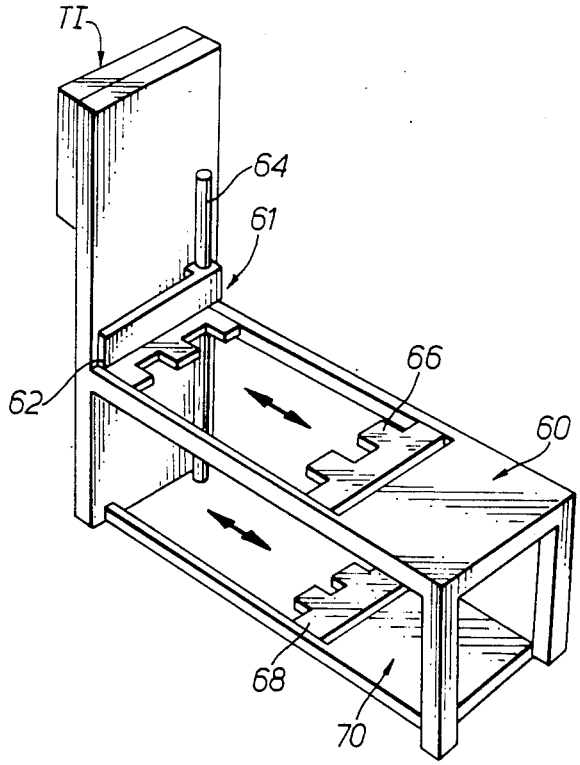
Figure 12:
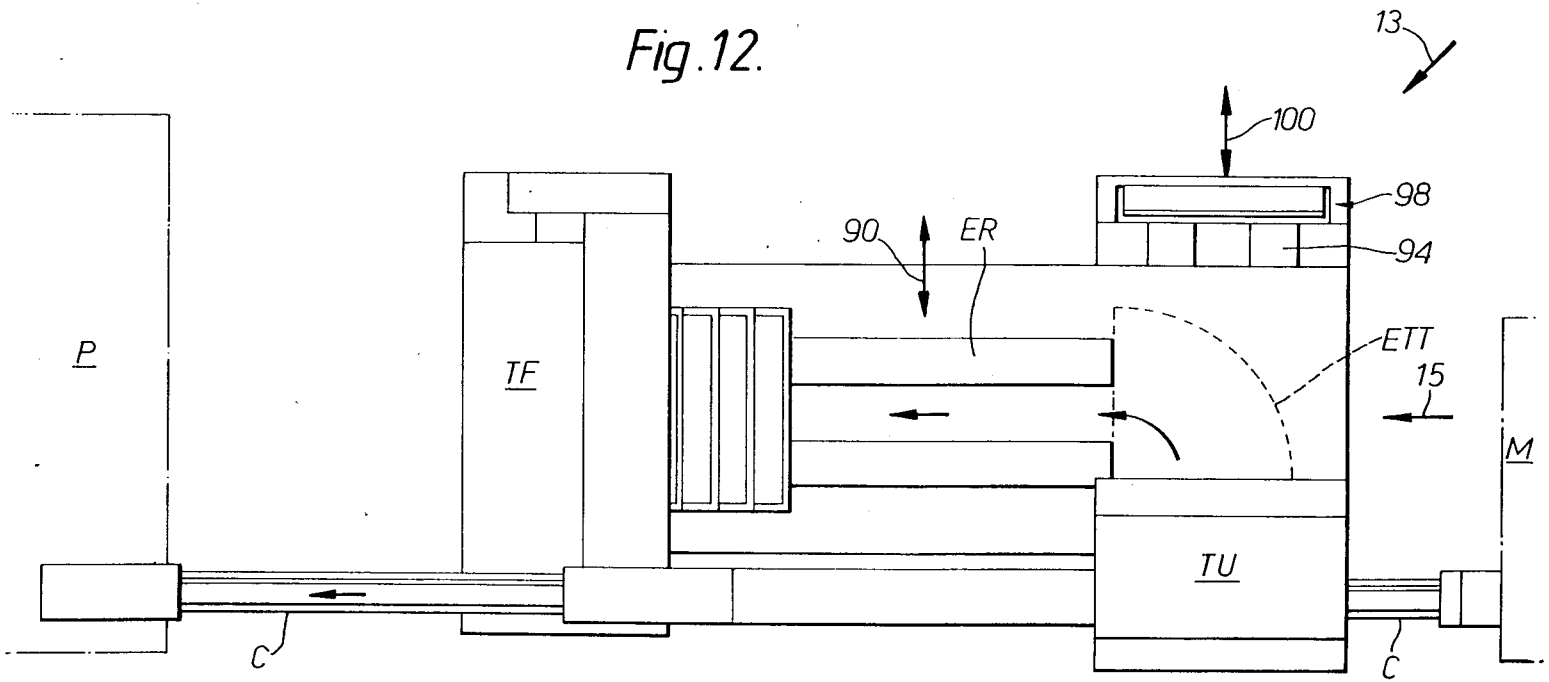
Figure 13:
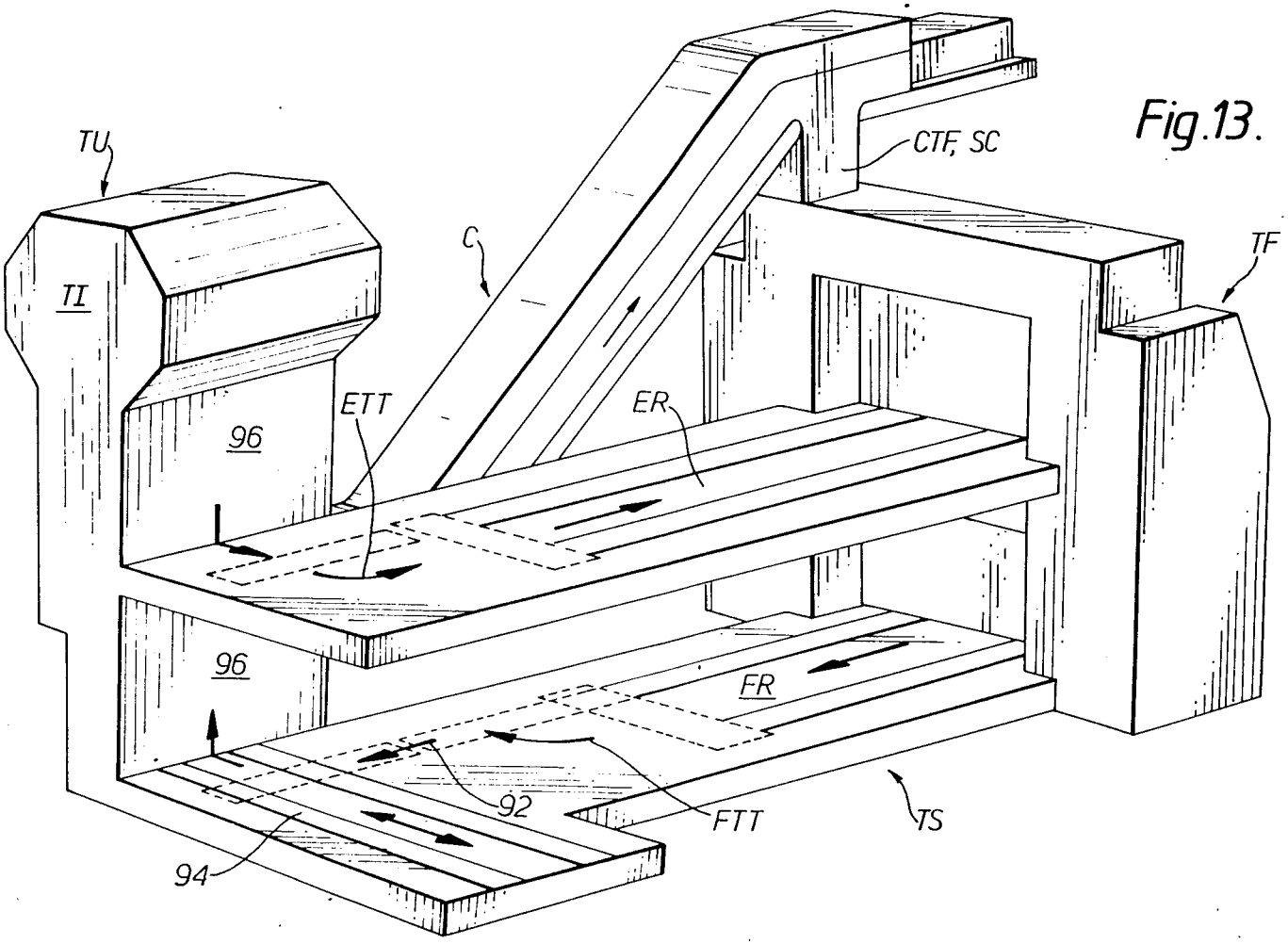
Figure 14:
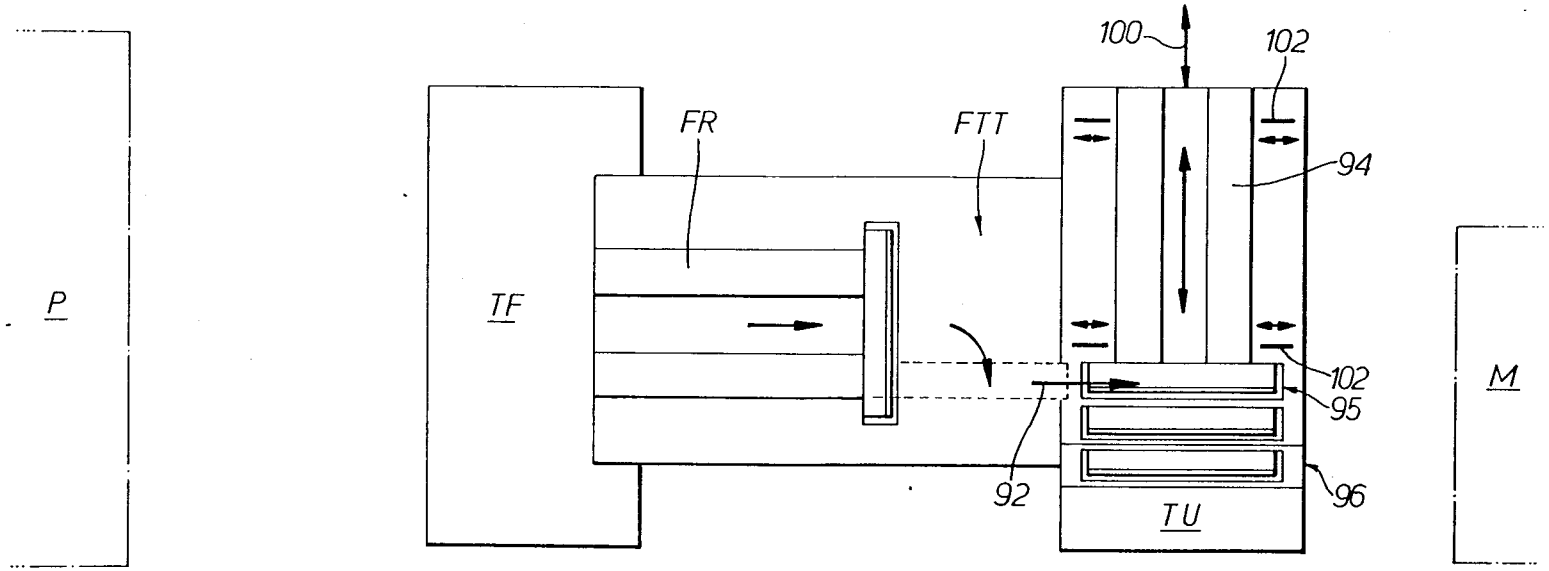
Figure 15:
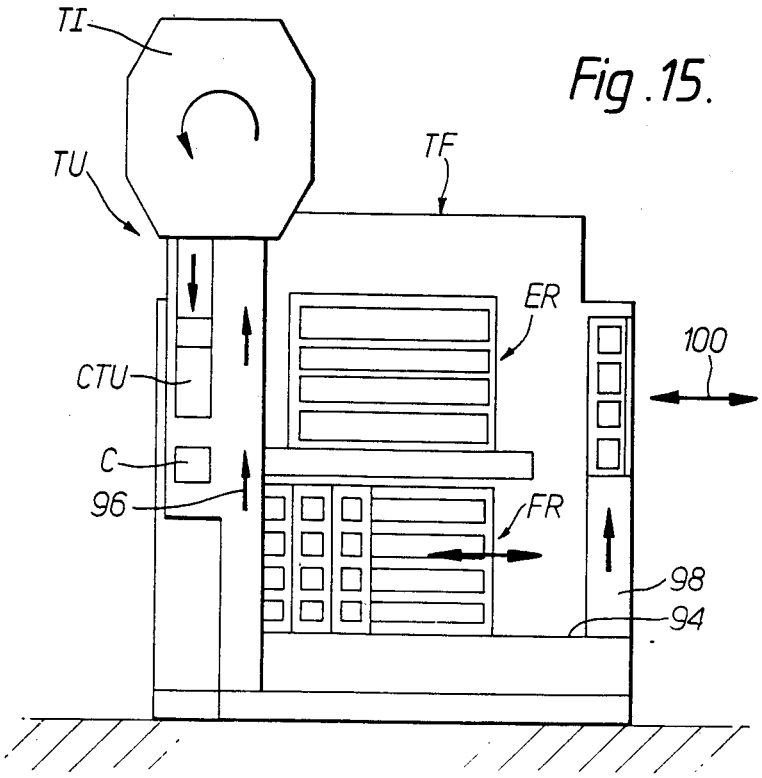
Figure 16:
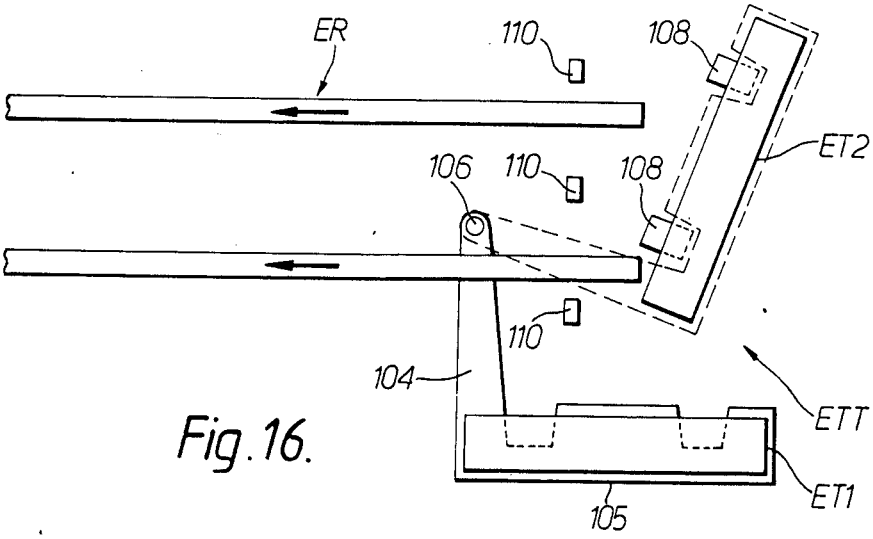
Figure 17:
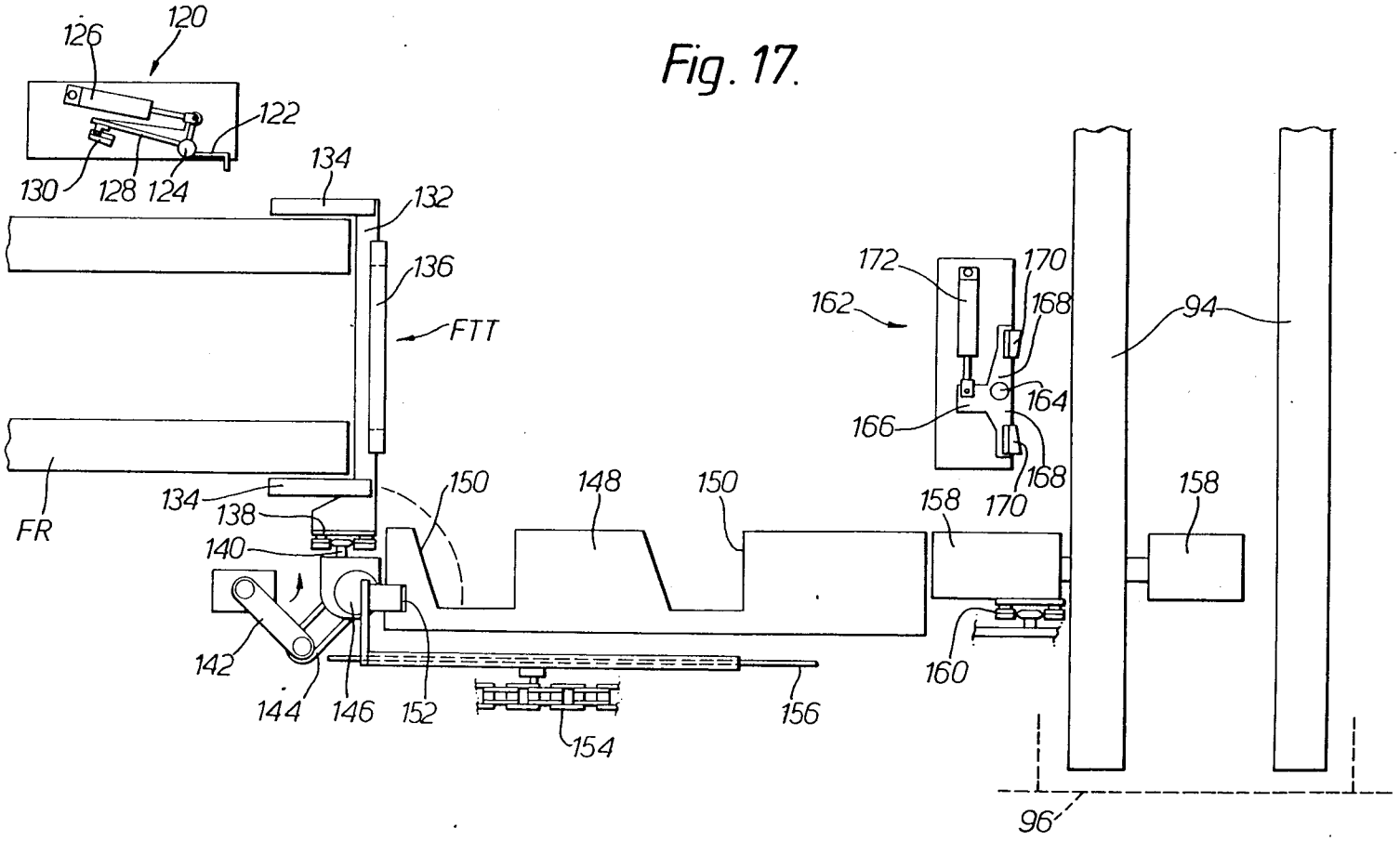
Figure 18:
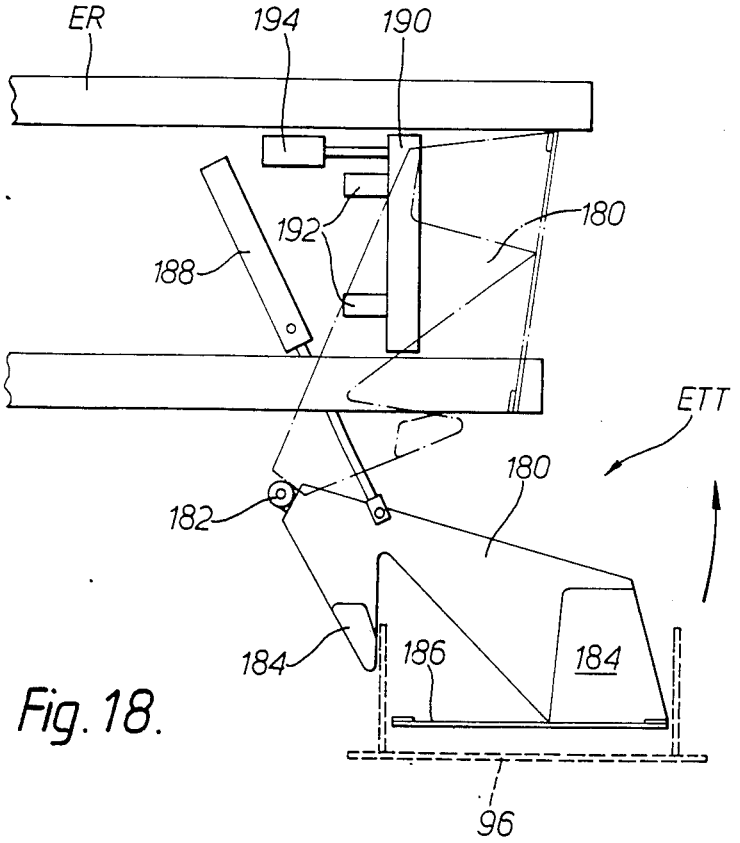
Figure 19:
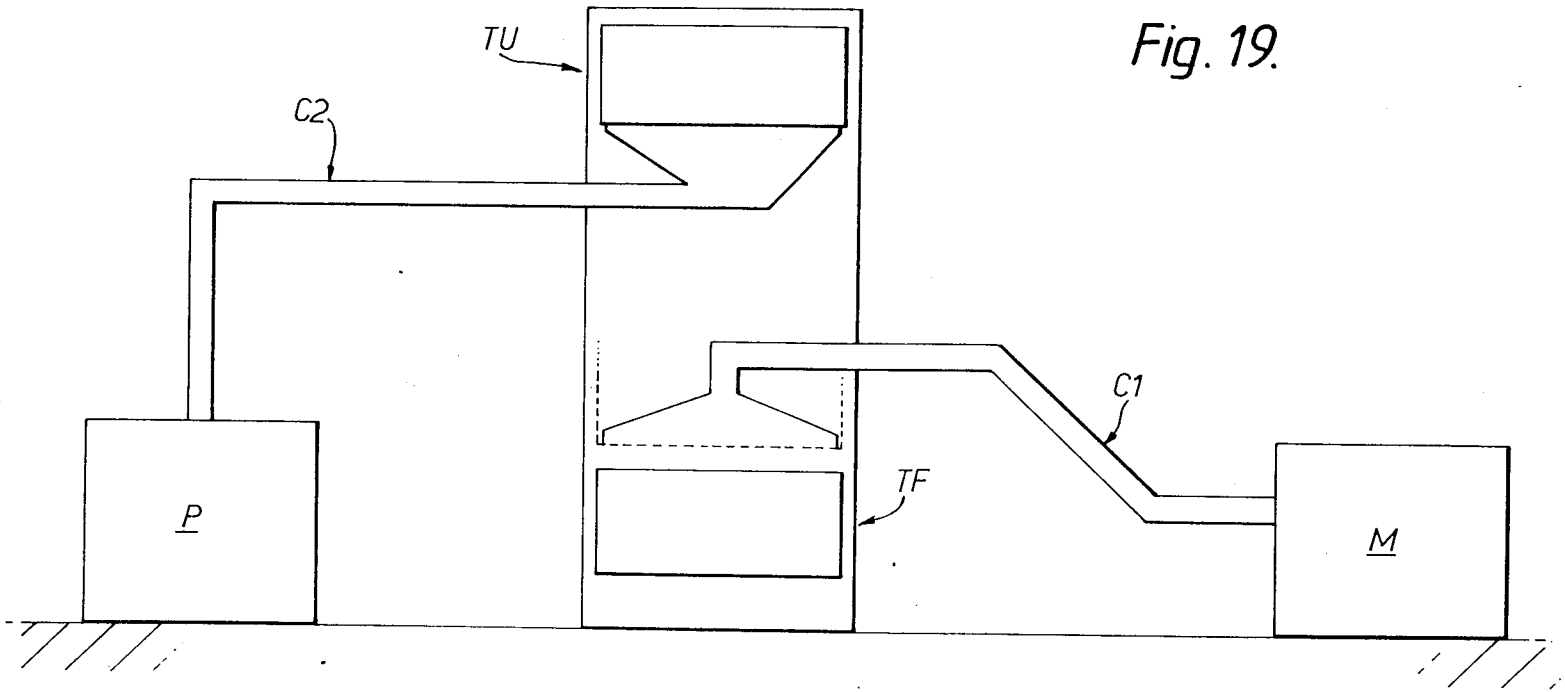
Figure 20:
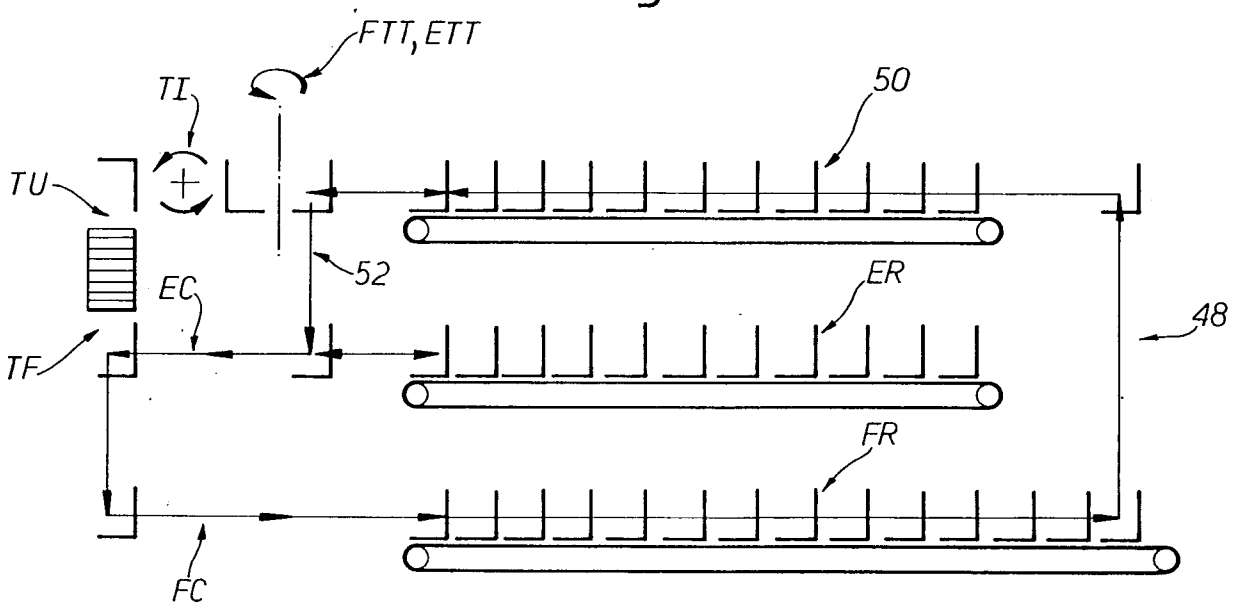
Figure 21:
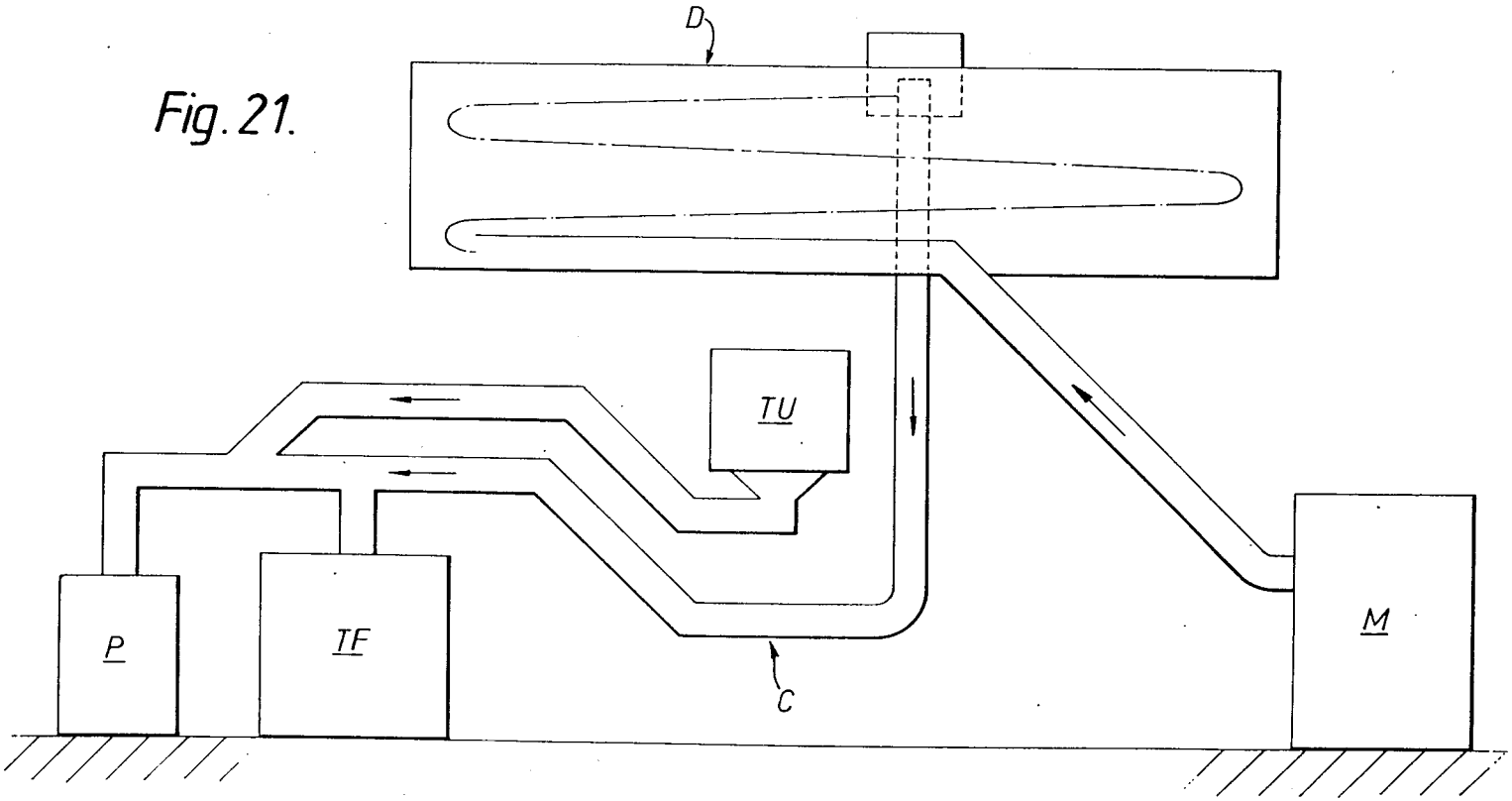

FIGS. 9A–H show a part of the system of FIG. 8 in various stages of operation, FIG. 10 shows another part of the system of FIG. 8, FIG. 11 is a view, similar to that of FIG. 10, showing further parts of the system of FIG. 8, FIG. 12 is a plan view of a modified version of the system of FIG. 8, FIG. 13 is a perspective view on the arrow 13 in FIG. 12, FIG. 14 is a plan view of a lower part of the system of FIG. 12, FIG. 15 is a view on the arrow 15 in FIG. 12, FIG. 16 is a plan view of a further part of the system of FIG. 12, FIG. 17 is a plan view of a tray conveying arrangement which may be used with the system of FIG. 12, FIG. 18 is a plan view of another tray conveying arrangement which may be used with the system of FIG. 12, FIG. 19 is a front view of a further tray reservoir system, FIG. 20 is a side view of the system of FIG. 19, and FIG. 21 is a front view of a still further tray reservoir system.

The tray reservoir systems shown in the drawings have various common elements including at least the majority of the following:

a cigarette making machine (or other rod producing machine such as a filter rod maker) M;

a cigarette packing machine (or other rod receiving device such as a pneumatic filter rod distribution device) P;

a mass flow conveyor C, by which a substantially continuous multi-layer stream of rod-like articles may be delivered from the maker M to the packer P;

a stack former ST, which forms a single row output of the maker M into a multi-layer stack on the mass flow conveyor C, a tray filler TF, which receives articles from the conveyor C, by way of a subsidiary conveyor CTF having a junction JTF with the conveyor C, and loads them into empty trays ET;

a tray unloader TU, which unloads full trays FT and forms a stream for delivery to the main conveyor C, by way of a subsidiary conveyor CTU and a junction JTU; and a tray handling device TS, including an empty tray conveyor EC and a full tray conveyor FC, and means for feeding full and empty trays between the tray filler TF and the tray unloader TU, and preferably also including a full tray reservoir FR and an empty tray reservoir ER from which trays may be manually or automatically removed and replaced, possibly by transfer to or from a tray conveyance system.

The tray filler TF is preferably of the type which allows direct loading into a tray from a hopper H and may be substantially as disclosed in British Patent Specification No. 2124174. This type of tray filler TF has an upper tray conveyor EC for delivering empty trays ET to a loading position, at which successive trays are filled while moving downwards, and a lower full tray conveyor FC for moving away the filled trays FT.

The tray unloader TU may be of the type in which successive full trays FT are delivered into a tray inverting device TI, which may comprise a pair of carriers arranged back to back and rotatable about a central transverse axis. The device TI may be similar to that disclosed in British Patent Specification No. 1517772, for example.

Sensors S1, S2 etc. may be provided at appropriate junctions or other positions on the conveyor C for control of the speed of conveyor C, or part of the conveyor C and/or other conveyors associated with it, and may be similar in construction and operation to those disclosed in British Patent Specification No. 1299174. The conveyor C may include an elevator E, which may be similar to that disclosed in British Patent Specification No. 1453191, and/or may be inclined. A common junction J may be provided for the junctions JTF and JTU respectively of the subsidiary conveyors CTF and CTU.

A full tray turning device FTT or empty tray turning device ETT may be provided for turning full or empty trays through an angle of 90° or 180° (or any other angle) about a substantially vertical axis to obtain correct orientation of the articles after unloading from the tray unloader TU. For similar reasons the subsidiary conveyors CTF and CTU may include twists (or turns) typically of 90° or 180° and may, therefore, include spiral conveyors SC which may comprise a twisted downdrop, a twisted band conveyor (which may elevate the articles), or a bend, as disclosed in British Patent Specification Nos. 1430061, 2056397 or 2207964.

Figure 1:
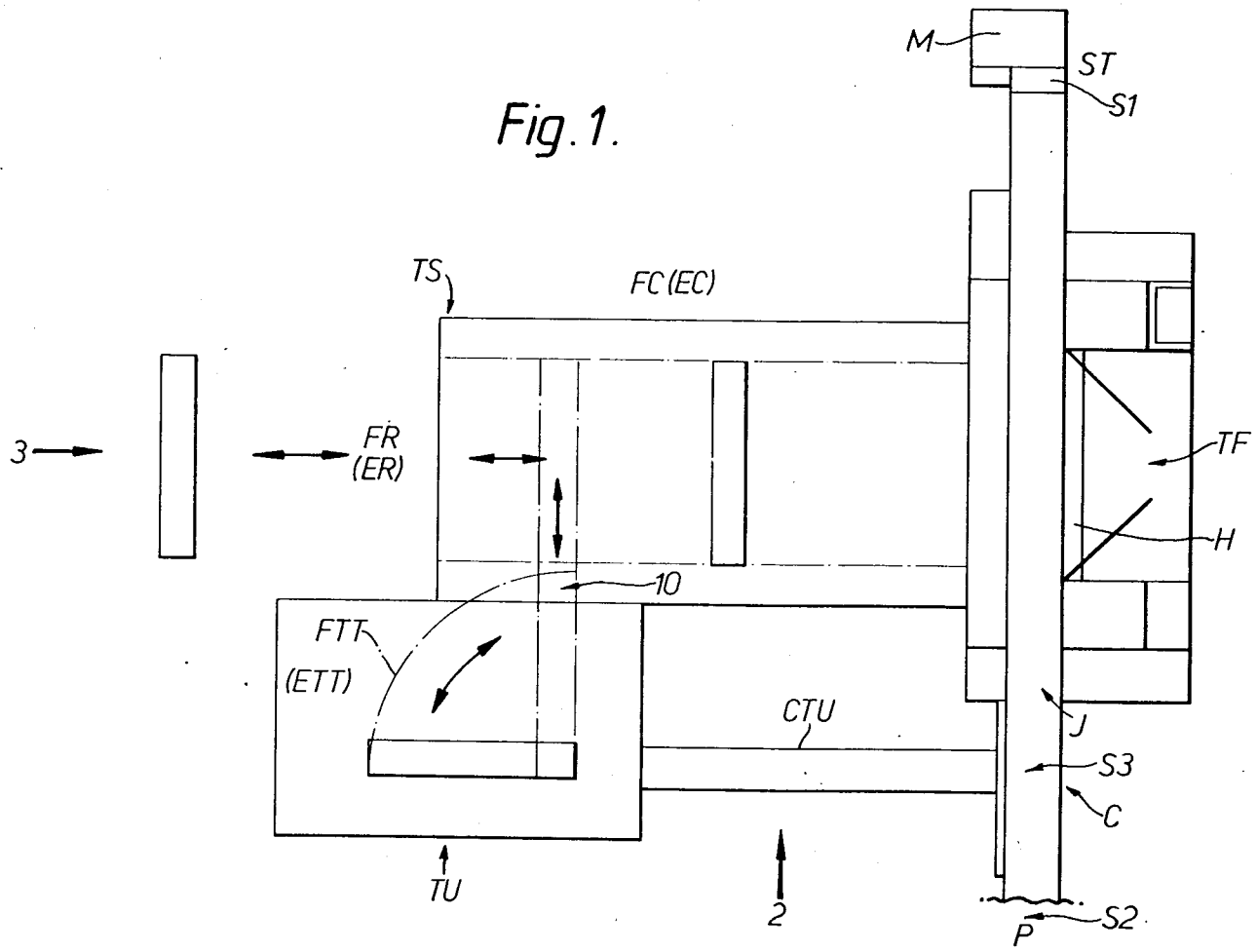
FIG. 1 is a plan view of a tray reservoir system.
Figure 2:
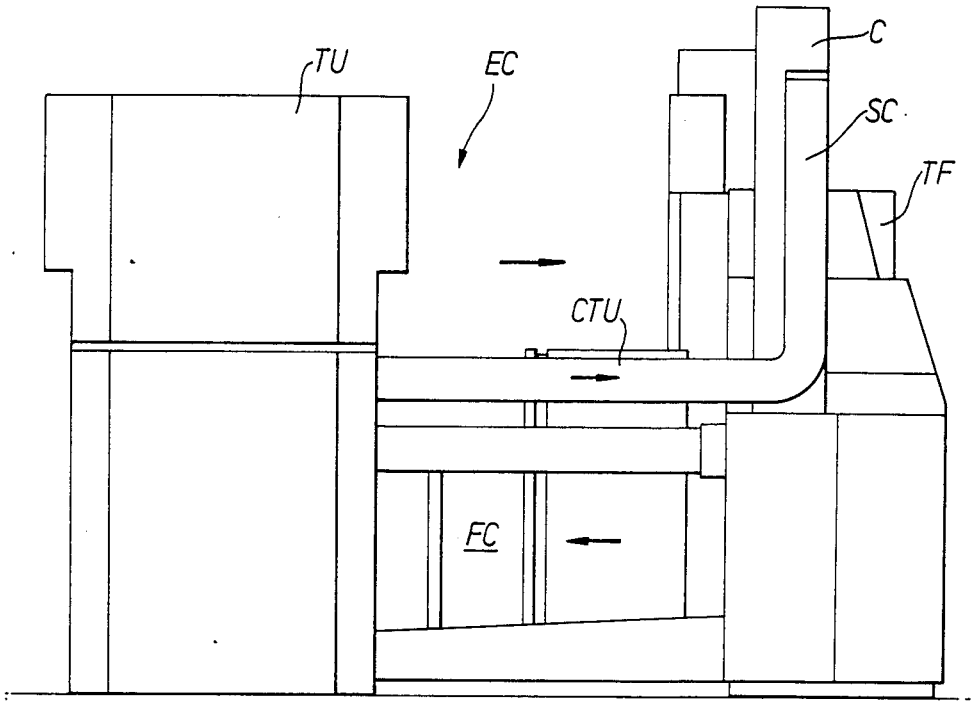
FIG. 2 is a view on the arrow 2 in FIG. 1.
Figure 3:
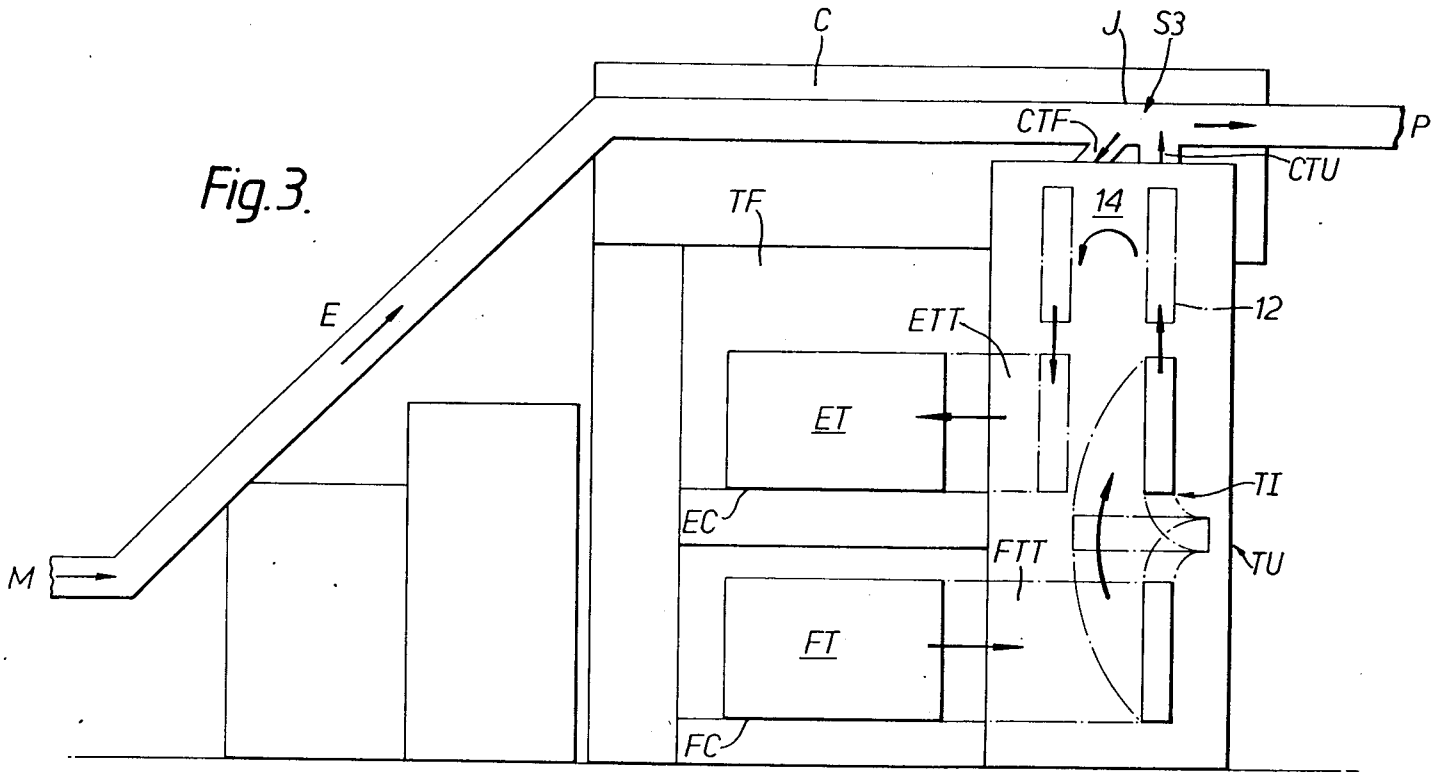
FIG. 3 is a view on the arrow 3 in FIG. 1.

In the tray reservoir system shown in FIGS. 1–3 the tray filler TF is arranged with its loading hopper H parallel to the conveyor C and connected to an inclined subsidiary conveyor CTF. The tray unloader TU is arranged at right angles to the conveyor C and parallel to the tray conveyors EC and FC. The elevator E is controlled by sensor S1. Operation of the tray unloader TU and tray filler TF are under control of the sensor S3 at the combined junction J: if the sensor S3 rises above its normal operating range this switches on the tray filler, and if the sensor S3 falls below its normal operating range this switches on the tray unloader. The conveyor C downstream of the junction J is controlled by sensor S2 at the packer P.

The tray handling device TS includes the empty and full tray conveyors EC, FC of the tray filler TF. Full trays delivered from the tray filler may pass to the full tray reservoir FR or may be pushed sideways at 10 (FIG. 1) into a full tray turn device FTT by which a tray may be swung through 90° before being elevated and inverted by the tray inverter device TI (FIG. 3). Subsequently, after unloading, the now empty tray is further elevated (at 12), and inverted again (at 14), so that it becomes upright and is delivered to the empty tray turn device ETT for return to the empty tray conveyor EC on a path above the path 10 of the full trays. From this position empty trays may be delivered to the empty tray reservoir ER or to the empty tray conveyor EC for delivery to the tray filler TF, as required.

As shown in FIG. 2, the subsidiary conveyor CTU includes a spiral twisting elevator SC for correct orientation of the articles unloaded by the TU upstream of the junction J.

The conveyor CTU could be arranged to joint the conveyor C at a separate junction under a further sensor S4. The sensor S4 would control the speed of the section of conveyor C between the junctions JTF and JTU. Operation of the tray filler and tray unloader would be controlled, as before, by the sensor S3.

Figure 4:
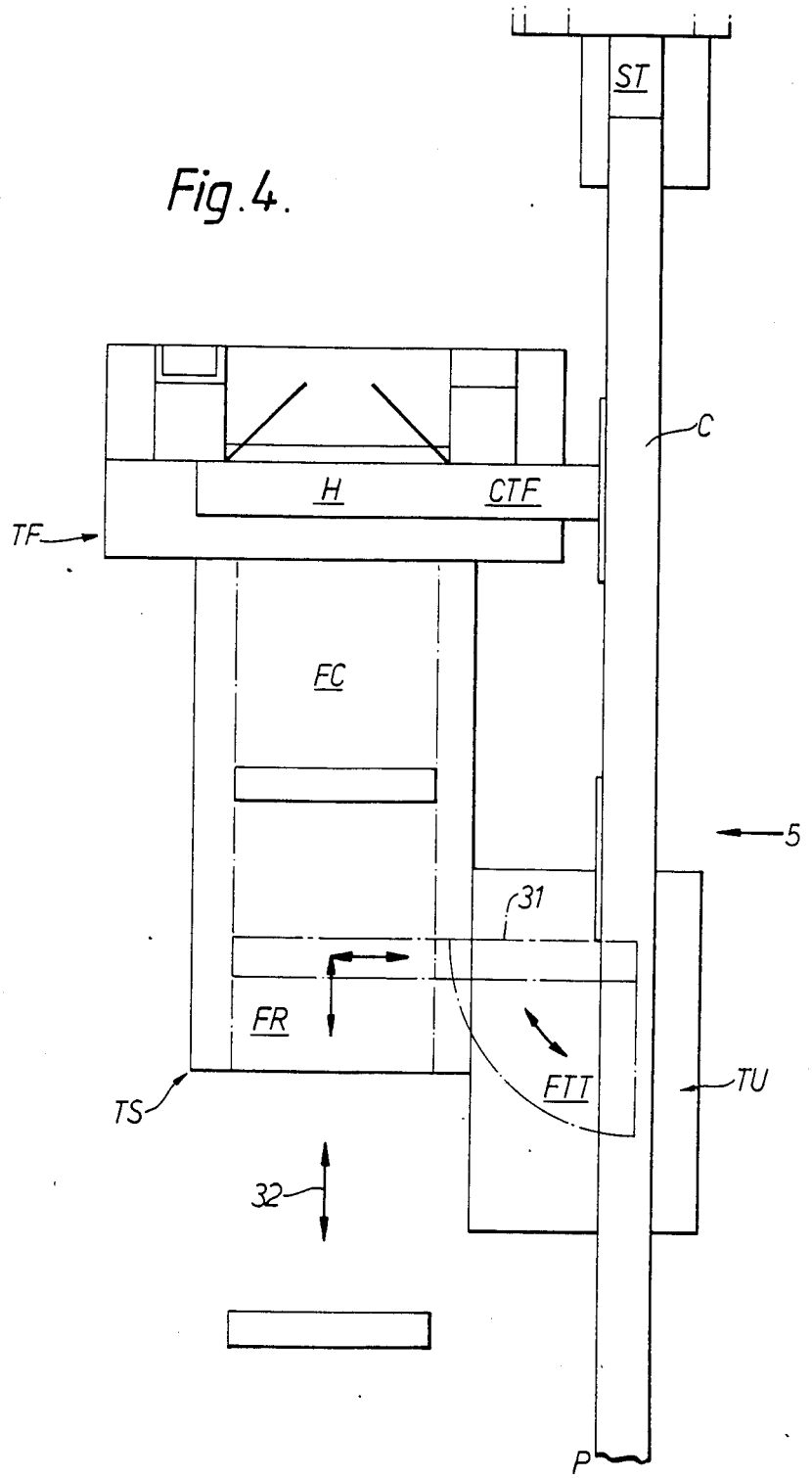
FIG. 4 is a plan view of another tray reservoir system.
Figure 5:
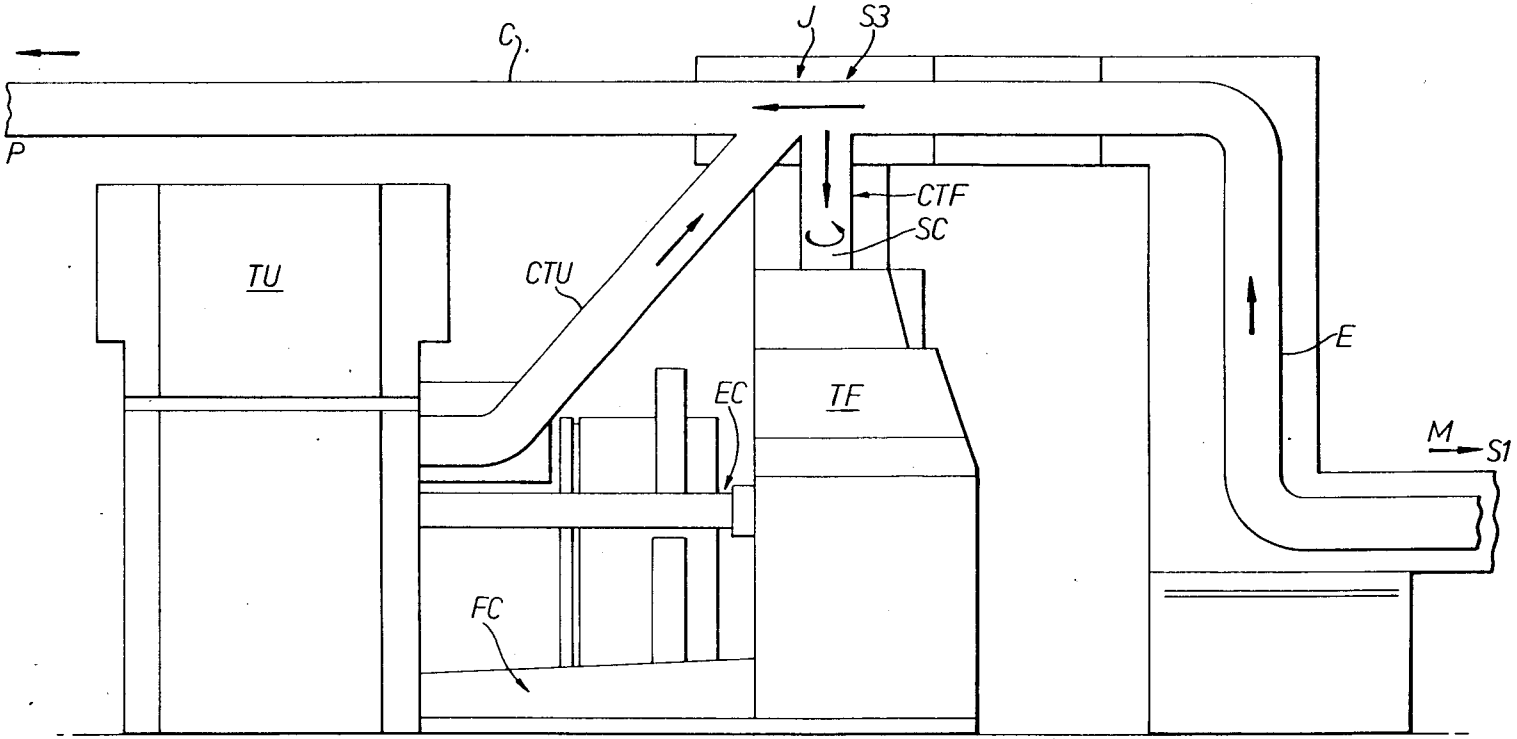
FIG. 5 is a view on the arrow 5 in FIG. 4.

In the system of FIGS. 4 and 5 the tray filler TF is arranged at right angles to the conveyor C and the tray unloader TU is arranged parallel to the conveyor C. Control of the system, by means of a sensor S3 above a combined junction J, is similar to that of the system of FIG. 1. Full trays delivered from the tray filler TF may pass to the full tray reservoir FR or, alternatively, be pushed sideways at 31 for delivery to a full tray turn device FTT and subsequent elevation and inversion at the tray unloader TU. Empty trays are moved on a substantially parallel path to return to the empty tray reservoir ER above the full tray reservoir FR. Empty and full trays may be added to the respective reservoirs ER, FR as indicated at 32.

Figure 6:
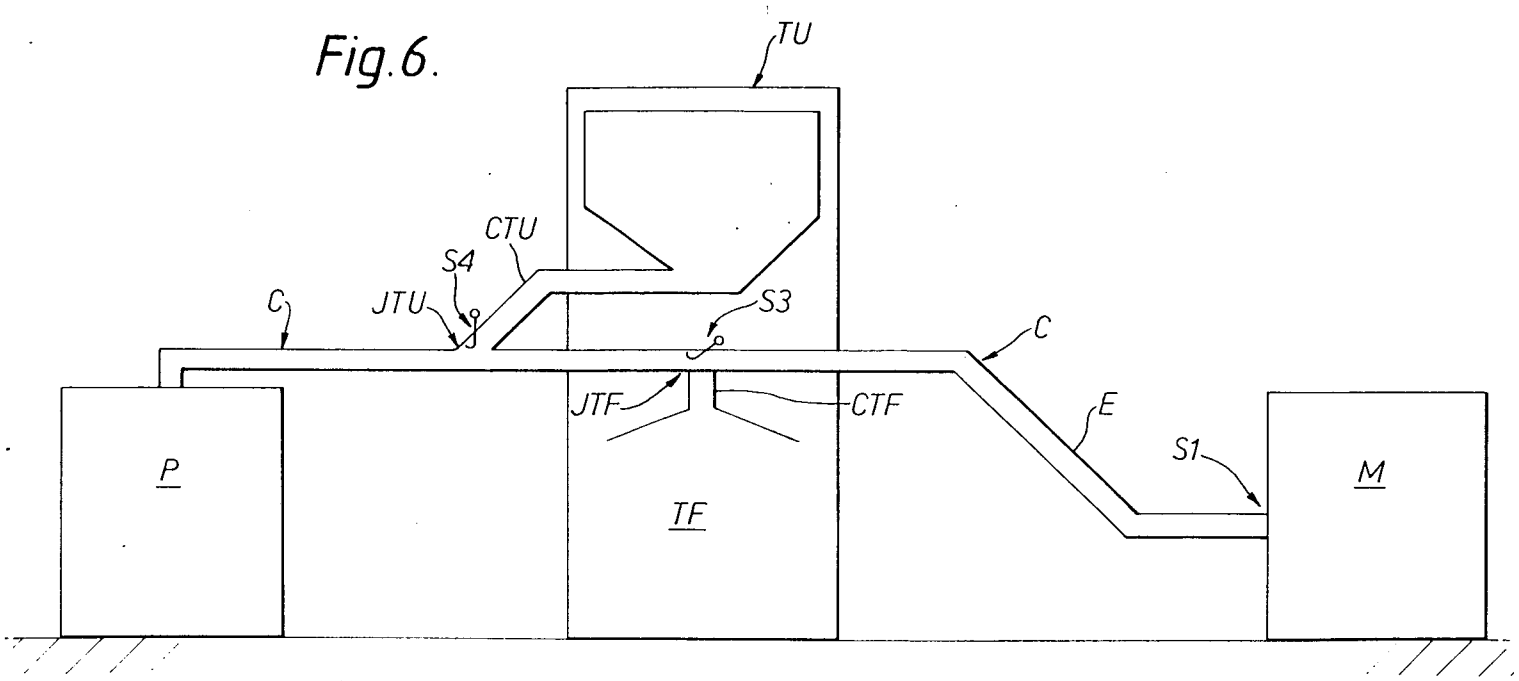
FIG. 6 is a front view of a further tray reservoir system.
Figure 7:
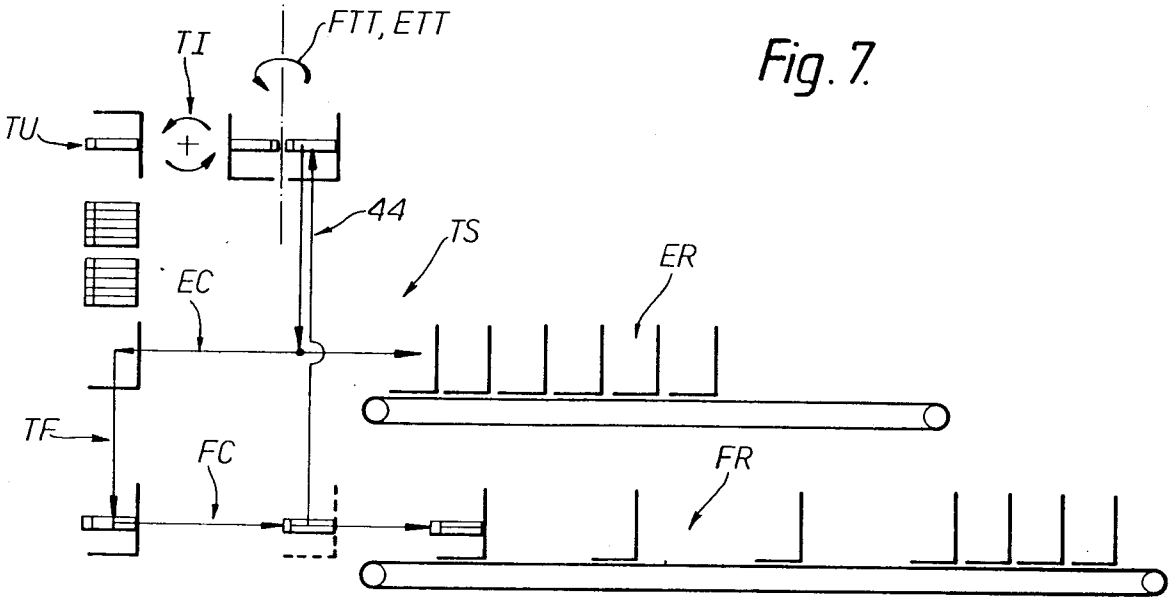
FIG. 7 is a side view of the system of FIG. 6.

FIGS. 6 and 7 show a system in which the tray filler and tray unloader are parallel to the conveyor C. The conveyor CTU is inclined and includes a pivoted flap sensor 24. The sensor S3 responds to a surplus of articles at the junction JTF and controls operation of the tray filler TF. If the level of sensor S3 falls, the section of conveyor C between the junctions JTF and JTU is slowed, thereby causing the level of sensor S4 at junction JTU to fall and start the tray unloader. Similarly a fall of the sensor S4 caused directly by the speeding up of the packer P causes operation of the tray unloader.

The tray handling device TS, as shown in FIG. 7, comprises a full tray elevator 44, arranged between the full tray conveyor FC and full tray reservoir FR. Full trays are elevated by the elevator 44 and pass the path of empty trays between the empty tray conveyor EC and the empty tray reservoir ER and are delivered to a full tray turn around device FTT, which turns the full trays through 180° prior to delivery to the tray inverting device TI of the tray unloader TU. Empty trays are returned by the same route, except that they are retained on the empty tray conveyor EC for delivery to the tray filler TF or into the empty tray reservoir ER.

FIGS. 8–11 show a further system. The conveyor C comprises a first section C1, extending from the stack former ST to the junction JTU with the tray unloader conveyor CTU, a second elevator section E extending from the junction JTU to the junction JTF with the tray filler conveyor CTF, and a third section C2 extending from the junction JTF to the packer P. The tray unloader TU is arranged parallel to and above the conveyor C1. The tray filler TF is at right angles to the conveyor C, and the conveyor CTF includes a 90° spiral downdrop SC.

Sensors S1, S2, S3, and S4 are arranged along conveyor C. These control the various sections of conveyor C and operation of the tray filler TF and the tray unloader TU as follows.

In normal operation, sensor S1 controls the conveyors C1 and E and sensor S2 controls conveyor C2. Thus, when the speeds of the maker M and packer P are the same, the speeds of conveyors C1, E and C2 are the same and sensor S3 is in its null position (or range), in which position neither tray filler TF nor tray unloader TU normally operates.

If the speed of the packer P increases, sensor S2 detects a fall in level of cigarettes and speeds up conveyor C2. This in turn causes the level at sensor S3 to fall and speeds up the elevator E by an amount corresponding to the difference in flow rates detected by sensors S1 and S3. Sensor S4 responds to the increase in speed of elevator E and starts the tray unloader TU and conveyor CTU at a rate sufficient to make up the difference between the flow rates. Similarly, if the speed of the maker M decreases, sensor S1 will detect a fall in level and will cause the conveyors C1 and E to slow down, so that again the level of sensor S3 will fall, and subsequent control of the tray unloader TU is as described above. If the maker M stops, the sensor S1 will stop conveyors C1 and E (unless E is already under control of the sensor S3 during tray unloading). Subsequently, while the maker M is stopped, tray unloading and elevator E are controlled by sensor S3.

If the packer P slows down or stops the sensor S2 will slow down or stop conveyor C2, which will cause a rise in level of sensor S3. This will start the tray filler TF and the conveyor CTF, and will control their operation at a speed sufficient to make up the difference between the speeds of the maker M and packer P. During the time the tray filler TF is running the tray unloader TU does not operate, and conveyors C1 and E are controlled solely by sensor S1. Similarly, if the maker M speeds up, the speeds of conveyors C1 and E will be increased by sensor S1, causing a rise in level of sensor S3 and operation of the tray filler TF as described.

The tray handling device TS comprises an upper combined empty tray conveyor and reservoir ER and a lower combined full tray conveyor and reservoir FR. During operation of the tray filler TF, empty trays are fed on the conveyor ER into the tray filler TF and the filled trays are fed onto the full tray conveyor FR. If the full tray reservoir FR becomes full one or more trays can be removed to a secondary reservoir 60. As shown in FIGS. 10 and 11 trays are conveyed from the full tray reservoir FR to the secondary reservoir 60 by a transfer device 61 which comprises a bracket 62 mounted on a vertical shaft 64 so as to be movable along the shaft and pivotable through 90° about the axis of the shaft. The bracket 62 is lowered on the shaft 64 and pivoted through 90° from the position shown in FIG. 10, so that it is arranged just below the level of the full tray FR and parallel to the trays in the reservoir. A single tray is fed from the reservoir FR onto the bracket 62 which is subsequently swung back through 90° and lifted to the level of the secondary reservoir 60. A further transfer bracket 66 arranged at the level of the reservoir 60 and having projections which intermesh with those on the bracket 62 is advanced so that on lowering of the elevator bracket 62 a full tray may be deposited on the transfer bracket 66, which subsquently retracts to transfer the full tray to the secondary reservoir 60. The elevator bracket 62 may continue to be lowered for collection of a further full tray from the reservoir FR. Typically the secondary reservoir 60 may have a capacity of four trays. If both reservoirs FR and 60 are full (and a full tray is on the transfer bracket 62) the device TS will switch off the maker M if the conditions on conveyor C require the tray filler to be brought into operation. The capacity of the full tray reservoir FR, and of the secondary reservoir 60 and empty tray reservoir ER, may be varied by varying the lengths of the respective conveyors.

During normal operation of the tray unloader TU full trays will be transferred by the transfer bracket 66 from the secondary reservoir 60 to the elevator bracket 62, which lifts the tray into the tray inverter TI of the tray unloader TU. If no trays are present in the reservoir 60 (as detected by a sensor associated with the reservoir 60) full trays will be obtained by the elevator bracket 62 directly from the reservoir FR. After unloading, the bracket 62 receives the empty tray and either deposits it on the empty tray reservoir ER or on to a transfer bracket 68 which is similar to the bracket 66 and which transfers the empty tray to a secondary empty tray reservoir 70.

Full trays may be added by an operator by placing them on the reservoir 60. Depending on the state of fill of the reservoir FR they may be immediately transferred to the reservoir FR. If the tray unloader TU is running, trays will be transferred directly from the reservoir 60 to the tray inverter TI.

Full trays may be removed on demand by requesting an appropriate number of trays to be removed from the reservoir FR and transferred to the reservoir 60 for removal by the operator. Empty trays can be added and removed directly from the reservoir ER (or from the secondary reservoir 70).

Supply of trays to and from the tray filler TF and the tray unloader TU takes precedence over any other tray handling operation exercised by the device TS, so that as far as possible the conveyance of articles on the conveyor C remains unaffected by tray movements.

FIG. 9 shows the tray unloader in various stages A-H of operation. The tray inverter TI is arranged to dump the contents of a full tray FT into a hopper H for delivery to the conveyor CTU. In stage A a full tray FT is located above a vertically movable section 72 of the hopper H. The level 74 of articles already in the hopper H is some way below the tray FT and the hopper section 72 and full tray FT are lowered until a detector senses that the bottom of the tray is just above the level 74 (stage B). The contents of the tray are then released (stage C). This may be achieved by retracting side supports which retain the ends of the articles in the tray (in a similar manner to that shown in British Patent Specification No. 1517772. The tray and hopper section 72 subsequently slide upwards to their normal height (stages D, E) and wait until the new level 74 has fallen to approximately 50 mm below the top of the hopper section 72 (stage F). The hopper section 72 then slides downwards about 45 mm (stage G) to allow room for the tray inverter TI to rotate to remove the empty tray ET and replace it with a full tray FT (stage H). Subsequently the hopper section 72 is raised again to the position shown in stage A and the cycle repeats as long as it is required to unload trays. Any drive mechanism capable of producing intermittent reciprocating movement and which may be stopped at variable positions (e.g. in response to a signal from the level detector) may be used for moving the hopper section 72.

By providing a slidable hopper section 72, to allow the gap between the contents of an unloading tray and the level of articles already in the hopper H of the tray unloader to be minimized, the speed of operation necessary for the tray inverter TI may be reduced, thereby reducing possible degradation of delicate articles handled by the trays. This is particularly important in the case of cigarettes.

During the unloading process (stages A–D) the tray FT is movable with the slidable hopper section 72. Subsequently (stages F–H) the tray (now empty, ET) is separated from the hopper section 72 and movable with the tray inverter TI, so that it may be removed and replaced. In order to achieve this the trays are received in the tray inverter TI in carrier frames which are releasably latched to the rotatable frame of the tray inverter. At the position shown in stage A the carrier frame supporting the tray FT is released from the frame of the tray inverter TI and is latched to the slidable hopper section 72. Subsequently the carrier frame slides relative to the tray inverter frame under action of the movement of the section 72. After stage D has been reached, with the carrier frame fully back in the tray inverter frame, the connection to the section 72 is released and the carrier frame re-latched to the tray inverter frame to allow separation from the hopper section 72 (stage F) and rotation of the tray inverter TI. The carrier frames are replaceable to adapt to different types of tray.

A modified version of the system shown in FIGS. 8–11 is shown in FIGS. 12–16. As can be seen from FIGS. 12 and 13 the arrangement of the tray filler TF and tray unloader TU in relation to the mass flow conveyor C linking the maker M and packer P is substantially as in the system of FIG. 8. Control and operation of the system of FIGS. 12–16 is substantially as with the system of FIGS. 8–11. The tray handling system TS of FIGS. 12–16 differs slightly, as explained below.

Empty trays ET are delivered to the tray filler TF from the empty tray conveyor and reservoir ER. Empty trays may be added to or removed from the system via the empty tray conveyor ER, as indicated at 90 in FIG. 12. As shown in FIGS. 13 and 14, full trays are delivered from the tray filler TF along the full tray conveyor and reservoir FR and are turned through 90° by a full tray turn device FTT, which may be similar to the device 61 of FIG. 10 (except that the device of FIG. 14 need not be vertically slidable). Subsequently a pusher removes a full tray from the device FTT and, as indicated at 92 in FIG. 14, moves it into a subsidiary reservoir and conveyor 94 at an intermediate position 95. The subsidiary conveyor 94 is reversible and, according to the current demands of the system TS, will move a full tray from the position 95 either towards an elevator 96 from which it is received in the tray inverter TI of the tray unloader TU or towards the main part of the reservoir of conveyor 94. At the end of this part of conveyor 94 is an operator elevator 98 (FIGS. 12, 15), which, if the subsidiary conveyor 94 becomes full, will elevate a full tray to a convenient height for removal by an operator (as indicated at 100 in FIGS. 12, 14 and 15). Full trays may also be introduced in the system TS by reversal of elevator 98 and conveyor 94. Movement of the trays on conveyor 94, particularly to and from the intermediate position 95 and to and from the elevator 98, is controlled by retractable gates 102 (FIG. 14).

Empty and/or full trays may be delivered to and removed from the elevator 98 (or any other appropriate part of the system TS) other than manually. For example a tray conveyance system incorporating trolleys may extend between separate systems TS. One example of a trolley conveyance system which could be used is disclosed in British Patent Specification No. 1532421, to which reference is directed for details.

FIG. 17 shows an arrangement for moving full trays in a system similar to that of FIGS. 12–16, and in particular shows an arrangement capable of producing the movements indicated diagrammatically in FIG. 14.

Full trays are advanced on the full tray conveyor and reservoir FR and are successively delivered to the full tray turn device FTT. Transfer of trays from the conveyor FR to the device FTT is controlled by a pair of tray clamps 120 arranged on opposite sides of the conveyor. The clamps 120, only one of which is shown in drawing, each comprise a cranked arm 122 for restraining a leading tray on the conveyor FR, the arm being pivoted about a rotable axis 124 and retractable by operation of a piston and cylinder 126. Also pivoted about the axis 124 and movable at the same time as the arm 122 is a further arm 128 having a tray clamping pad 130. The arrangement is such that when the pistons and cylinders 126 are operated to retract the arms to release a leading tray on the conveyor FR the clamping pads 130 are advanced to prevent movement of the next following tray. Consequently, the conveyor FR advances a single leading tray to the end of the conveyor FR.

The full tray turn device FTT, which is arranged just beyond the conveyor FR, comprises a cantilevered arm 132 having tray support forks 134 and a tray support back 136. The arm 132 is vertically movable on a slide 138 attached to a stub arm 140. The arm 132 may therefore be raised slightly to pick up a full tray from the end of the conveyor FR. The arm 140, and hence the arm 132 and the tray support forks 134, may be moved through 90° from the position shown in the drawing, by rotation of crank 142 and link 144 to rotate the arm 140 about an axis 146.

Subsequent to rotation of the full tray turn device FTT the arm 132 lies parallel to and below a stationary tray support surface 148, having cut-outs 150 through which project the tray support forks 134 and upright elements of the tray support back 136. From this position the arm 132 is lowered slightly so that the tray is deposited on the surface 148, where it lies in the path of a pusher 152 driven by a chain 154 and guided by a track 156. The path of the pusher 152 lies above the tray support back 136.

The pusher 152 moves a full tray over the surface 148 and onto further support surfaces 158 lying at a level slightly above the subsidiary reservoir and conveyor 94. The surfaces 158 are mounted on a vertical slide 160, so that the full tray may be deposited on the conveyor 94 by slight downward movement of the surfaces 158. The full tray is then in a position corresponding to the intermediate position 95 in FIG. 14. Movement of trays on the conveyor 94 is controlled by means of a double acting clamp 162, which cooperates with a further clamp (not shown) on the opposite side of conveyor 94. The clamp 162 comprises a pivot axis 164 on which is mounted an element 166 having integral arms 168 extending on opposite sides of the axis and each carrying tray clamping pads 170. The element 166 is rotatable about the axis 164 by operation of a piston and cylinder 172. The clamp 162 is thus able to control movement of trays in either direction of the conveyor 94.

Empty trays which have been unloaded at the tray unloader TU are returned from the tray inverter by way of elevator 96 and are intercepted at approximately the level of the empty tray conveyor ER by an empty tray turn device ETT. This rotates the empty trays for delivery back onto the empty tray conveyor ER. FIG. 16 shows one form of empty tray turn device ETT, comprising a cranked bracket 104 including a support 105 for an empty tray ET1 received from the tray elevator 96. The bracket 104 is pivotable about a substantially vertical pivot axis 106 to move the tray ET1 to a position corresponding to that of the tray ET2 in FIG. 16, i.e. through an angle somewhat less than 90°. At this position the tray ET2 is engaged by driven or idler rollers 108 (which project through cut-outs in the support 105) and moved onto the end of the empty tray conveyor ER. The tray ET2 is thus driven from the support 105 onto the bands of conveyor ER and remains at an angle to the bands until it is straightened by progressive engagement with retractable hinged gates 110. The gates 110 are retracted only when detectors indicate that the tray ET2 has been straightened. By using a cranked bracket 104 it is possible to extend the conveyor ER further towards the elevator 96 of the tray unloader TU (i.e. towards the position at which tray ET1 is received) and hence increase the length and capacity of the empty tray reservoir ER.

Another form of empty tray turn device ETT is shown in FIG. 18. This comprises a tray support 180 pivoted about a vertical axis 182 and having tray support surfaces 184 and a tray support back 186. In the position shown in full line in the drawing the support 180 is located so that an empty tray may be received from the elevator 96. The support 180, carrying an empty tray, is subsequently pivoted about the axis 182 under action of the piston and cylinder 188 until it reaches the position shown in chain dot lines in the drawing, wherein the empty tray is deposited on the empty tray conveyor and reservoir ER at an angle. Downstream of this position relative to the conveyor ER is a rotatable shaft 190 carrying a pair of short arms 192. The shaft 190 may be rotated by means of a crank connected to a piston and cylinder 194 so that the arms 192 restrain the empty tray on the conveyor ER until is has been straightened, i.e. until it is at right angles to the conveyor ER. When this is detected, e.g. by a sensor on one of the arms 192, the piston and cylinder 194 is operated to rotate the shaft 190 so that the arms 192 are removed from the path of the empty tray, which may then advance with the conveyor ER.

In another possible system the tray filler and the tray unloader are each arranged at right angles to the conveyor C, with the tray unloader downstream of the tray filler and each of the conveyors CTF and CTU including a 90° spiral downdrop SC.

It may noted that the transfer position of the tray filler TF and the tray unloader TU are disposed at 90° to each other in the system of FIGS. 1–3, 4–5, 8–11, and 12–16. Consequently, either of the tray handling arrangements TS described in some detail with respect to FIGS. 8–11 and FIGS. 12–16 is usable with any other of those systems.

Alternatively full trays could be delivered from the tray filler TF to the inverter TI of the tray unloader without change of orientation, so that the conveyor CTU includes a spiral downdrop SC for twisting the articles through 180° to achieve correct orientation for rejoining the main stream on conveyor C.

The various tray movements required in the systems, other than those explicitly described or illustrated, may be achieved by conventional tray moving means, e.g. band conveyors, pneumatically operated pistons, chain elevators etc.

In the systems where the junction JTF is downstream of the junction JTU there is a possibility, as has already been mentioned, that articles unloaded from a tray at the tray unloader will be loaded into a tray at the tray filler. This possibility is increased if the tray filler and the tray unloader operate simultaneously.

Problems of recirculation between the tray unloader and the tray filler in a system retaining the tray handling arrangement TS described with reference to FIGS. 8–11 or FIGS. 12–16 may be substantially eliminated by moving the junction JTU (between the conveyors C and CTU) downstream of the junction JTF (between the conveyors C and CTF). Thus, referring to FIG. 8, the conveyor CTU may be extended by means of a section parallel to the elevator E and terminate in a junction downstream of that between that of the elevator E, conveyor C2 and conveyor CTF.

Any of the junctions JTF, JTU in the illustrated systems may, in principle, be provided with a selectively operable closure to close the path leading to the tray filler TF and/or tray unloader TU. In this way, and by operating the closure, stationary articles may be protected from degradation caused by passage of adjacent articles, e.g. when the tray filler TF and/or tray unloader TU is out of operation for long periods. A rolling band closure of the type disclosed in U.S. Pat. No. 4,366,895 could be used as shown at 63 in FIG. 8, for example.

FIGS. 19 and 20 show a system which is similar in some respects to that of FIGS. 6 and 7, but which is intended for use between a filter rod making machine M and a pneumatic filter rod distributor P. In this system the mass flow conveyor between the maker M and distributor P is in two sections C1, C2 and all articles leaving the maker are loaded into trays at the tray filler TF. Full trays are delivered by the tray filler TF onto the full tray conveyor FC and subsequently pass into the full tray reservoir FR. At the end of the full tray reservoir FR is an elevator 48 by which all full trays are elevated to an upper full tray reservoir and conveyor 50 which delivers the trays to a combined full and empty tray turn around device FTT, ETT. The full trays are successively delivered from the device FTT to the tray inverter TI of the tray unloader TU, the empty trays being returned by the device ETT to a position from which they are lowered on a conveyor 52 for delivery to the empty tray conveyor EC of the tray filler TF or into the empty tray reservoir ER.

It can be seen, therefore, that all filter rods passing from the maker M to the distributor P are loaded into trays at the tray filler and unloaded from trays at the tray unloader. The time taken during which the trays are conveyed from the tray filler to the tray unloader is selected to allow adequate curing time for the filter rods. The full tray reservoirs FR and 50 constitute a delay line for the filter rods.

FIG. 21 shows another system for use between a filter rod making machine M and a pneumatic filter rod distributor P. In this system the conveyor C extends continuously from the maker M to the distributor P and includes a section D comprising a number of turns of a generally helically extending conveyor having an inlet at a lower end and an outlet at an upper end. The section D may be substantially similar to the delay line section of Molins POLAR filter rod handling system. Downstream of the section D are a tray unloader TU and tray filler TF incorporating a handling system which may be substantially similar to that associated with FIGS. 8–11 including any of the possible modifications to that system described herein. The section D, which may hold in excess of 100,000 filter rods at any one time, constitutes a delay line for filter rods produced by the machine, thereby allowing time for curing of the rods before they enter the distributor P and are subsequently passed for making into filter cigarettes.

Certain of the conveyors shown in the drawings are inclined: in all cases the angle of inclination is 45°.

We claim:

1. Apparatus for conveying rod-like articles of the tobacco industry, comprising an article delivery device, an article receiving device, conveyor means for conveying articles away from the delivery device and for conveying articles towards the receiving device, said conveyor means being arranged to convey articles in multi-layer stack formation, a container loading means, a container unloading means, said loading and said unloading means being arranged to receive containers in non-parallel orientations, a first subsidiary conveyor linking the container loading means and said conveyor means, a second subsidiary conveyor linking the container unloading means with said conveyor means, and a container handling system including means for conveying a container between said loading and said unloading means, said container conveying means including means for turning a container about a generally vertical axis.

2. Apparatus as claimed in claim 1, wherein said container conveying means includes first means for turning full containers and second means for turning empty containers.

3. Apparatus as claimed in claim 2, wherein said first and second turning means are arranged at different levels.

4. Apparatus as claimed in claim 1, wherein said turning means comprises a container support pivotable about a substantially vertical axis.

5. Apparatus as claimed in claim 4, including means for elevating and lowering said support.

6. Apparatus as claimed in claim 1, wherein said conveyor means includes a junction with said first subsidiary conveyor means, a junction with said second subsidiary conveyor means, and a straight conveyor section between said junctions, said container unloading means being substantially parallel to said section.

7. Apparatus as claimed in claim 6, wherein said container loading means is arranged substantially at 90° to said container unloading means.

8. Apparatus as claimed in claim 1, wherein the container handling system includes an empty container reservoir and a full container reservoir, each arranged for direct transfer to and from the container loading means and extending in a direction at 90° to said container loading means.

9. Apparatus as claimed in claim 8, including a second full container reservoir extending at 90° to said unloading means.

10. Apparatus as claimed in claim 9, wherein said container handling system includes means for transferring full containers from said full container reservoir to said second full container reservoir, said transferring means including said turning means.

11. Apparatus as claimed in claim 10, including reversible conveying means for conveying a full container from said transferring means into said second full container reservoir and from said second full container reservoir to said container unloading means.

12. Apparatus as claimed in claim 11, wherein said transferring means is arranged to deliver a full container to an intermediate position between said second full container reservoir and said container unloading means, said reversible conveying means being arranged to transfer a container from said intermediate position to said container unloading means.

13. Apparatus as claimed in claim 1, wherein said conveyor means is arranged to convey a continuous stream of articles in multi-layer stack formation from said delivery device to said receiving device.

14. Apparatus as claimed in claim 1, including a first junction between said first subsidiary conveyor and said conveyor means, including means for turning articles about an axis substantially transverse to their lengths during conveyance in multi-layer stack formation downstream of said first junction.

15. Apparatus as claimed in claim 14, wherein at least one of said subsidiary conveyors includes said article turning means.

16. Apparatus as claimed in claim 15, wherein at least one of said subsidiary conveyors includes means for twisting articles about an axis parallel to their direction of movement.

17. Apparatus as claimed in claim 14, wherein said conveyor means includes said article turning means.

18. Apparatus as claimed in claim 14, wherein said container turning means is arranged to turn articles through a first angle and said article turning means is arranged to turn articles through a second angle, the sum of said first and second angles being 180°.

19. Apparatus as claimed in claim 18, wherein said first and second angles are 90°.

20. Apparatus for conveying rod-like articles of the tobacco industry, comprising an article delivery device, an article receiving device, conveyor means for conveying articles away from the delivery device and for conveying articles towards the receiving device, said conveyor means being arranged to convey articles in multi-layer stack formation, a container loading means, a container unloading means, a first subsidiary conveyor linking the container loading means with said conveyor means, a second subsidiary conveyor linking the container unloading means with said conveyor means, and a container handling system including means for conveying a container between said loading and unloading means, said container conveying means including a common container reservoir from which reservoir empty or full containers are delivered respectively to said loading means of said unloading means, a secondary container reservoir from which containers may be added to or removed from said container conveying means, and means for transferring containers between said common reservoir and the secondary reservoir.

21. Apparatus as claimed in claim 20, wherein said common reservoir includes unidirectional container conveyors for full containers and empty containers, and said secondary container reservoir includes at least one reversible container conveyor.

22. Apparatus as claimed in claim 21, wherein said secondary reservoir is arranged so that containers are stored along a line at 90° to a line along which they are stored in the common reservoir.

23. Apparatus as claimed in claim 22, wherein said transferring means includes container turning means.

24. Apparatus as claimed in claim 23, wherein said common reservoir includes separate full and empty container conveyors, further including separate conveyor turning means for full and empty containers.

25. Apparatus as claimed in claim 24, wherein said common reservoir includes vertically spaced full and empty container reservoirs.

26. Apparatus as claimed in claim 20, wherein said common reservoir is associated with one of said loading and unloading means and said secondary container reservoir is associated with the other of said loading and unloading means, said transferring means being arranged to supply containers to an intermediate position of said secondary container reservoir, and further including means for delivering a container from said intermediate position in a first direction to said other one of said loading and unloading means or in a second direction to a further position at which the container may be transferred to or from said container handling system.

27. Apparatus for conveying rod-like articles of the tobacco industry, comprising an article delivery device, an article receiving device, conveyor means for conveying articles away from the delivery device and for conveying articles towards the receiving device, said conveyor means being arranged to convey articles in multi-layer stack formation, a container loading means, a container unloading means, a first subsidiary conveyor linking the container loading means with said conveyor means, a second subsidiary conveyor linking the container unloading means with said conveyor means, and a container handling system including means for conveying a container between said loading and unloading means, said container conveying means including container turning means, wherein at least one of said first and second subsidiary conveyors includes a portion along which articles are turned about an axis at 90° to their lengths, and at least one of said loading means and unloading means is arranged at 90° to an adjacent portion of said conveyor means.

28. Apparatus as claimed in claim 27, wherein said loading means and unloading means are arranged at 90° to each other.

29. Apparatus for conveying rod-like articles of the tobacco industry, comprising an articles delivery device, an article receiving device, conveyor means for conveying articles away from the delivery device and for conveying articles towards the receiving device, said conveyor means being arranged to convey articles in multi-layer stack formation, a container loading means, a container unloading means, a first subsidiary conveyor linking the container loading means with said conveyor means, a second subsidiary conveyor linking the container unloading means with said conveyor means, and a container handling system including means for conveying a container between said loading means and unloading means, wherein at least one of said first and second subsidiary conveyors includes a portion along which articles are turned about an axis at 90° to their lengths, and at least one of said loading and said unloading means is arranged at 90° to an adjacent portion of said conveyor means, and wherein at least one of said subsidiary conveyors includes a selectively operable closure to prevent passage of articles between the subsidiary conveyor and said conveyor means.

30. Apparatus as claimed in claim 27, wherein said conveyor means includes interconnected adjacent portions extending in opposite directions, whereby said articles are provided with an increased path length on said conveyor means.

31. Apparatus as claimed in claim 27, wherein said conveyor portion includes means for twisting articles about an axis substantially parallel to their direction of movement.

32. Apparatus for conveying rod-like articles of the tobacco industry, comprising an article delivery device, an article receiving device, conveyor means for conveying articles away from the delivery device and for conveying articles towards the receiving device, said conveyor means being arranged to convey articles in multi-layer stack formation, a container loading means, a container unloading means, a first subsidiary conveyor linking the container loading means with said conveyor means, a second subsidiary conveyor linking the container unloading means with said conveyor means, said loading means and said unloading means being arranged so that said first and second subsidiary conveyors respectively convey articles in different orientations adjacent said loading means and unloading means, a container handling system including means for conveying a container between said loading means and said unloading means, said container conveying means including means for turning a container from a first to a second angular position such that articles in said container are disposed in non-parallel positions, respectively, in said first and second angular positions, and means for turning articles about an axis substantially transverse to their lengths during conveyance in multi-layer stack formation, whereby articles on said second subsidiary conveyor may be recombined with articles on said conveyor means in the same orientation.

33. Apparatus for conveying rod-like articles of the tobacco industry, comprising an articles delivery device, an article receiving device, conveyor means for conveying articles away from the delivery device and for conveying articles towards the receiving device, said conveyor means being arranged to convey articles in multi-layer stack formation, a container loading means, a container unloading means, a first subsidiary conveyor linking the container loading means with said conveyor means at a first junction, a second subsidiary conveyor linking the container unloading means with said conveyor means at a second junction, and a container handling system including means for conveying a container between said loading means and said unloading means, wherein said first junction is upstream of said second junction relative to the direction of movement of articles on said conveyor means, and said unloading means is upstream of said loading means relative to said direction.

* * * * *